United States Patent [19]

Böhlmark

[11] 4,020,755

[45] May 3, 1977

[54] PRESS BINDING MACHINE

[75] Inventor: Sven Arne Böhlmark, Sundsvall, Sweden

[73] Assignee: Sunds Aktiebolag, Sundsvall, Sweden

[22] Filed: Jan. 26, 1976

[21] Appl. No.: 652,404

[30] Foreign Application Priority Data

Feb. 10, 1975 Sweden ..... 7501459

[52] U.S. Cl. ..... 100/12; 100/3; 100/26; 100/31

[51] Int. Cl.[2] ..... B65B 13/04

[58] Field of Search ..... 100/3, 12, 26, 31

[56] References Cited

UNITED STATES PATENTS

| | | | |
|---|---|---|---|
| 3,195,444 | 7/1965 | McLean | 100/3 |
| 3,352,228 | 11/1967 | Hill | 100/12 |
| 3,548,739 | 12/1970 | Glasson | 100/12 |
| 3,675,569 | 7/1972 | Moor | 100/3 |
| 3,797,381 | 3/1974 | Glasson | 100/12 |
| 3,889,584 | 6/1975 | Wiklund | 100/26 |

*Primary Examiner*—Billy J. Wilhite
*Attorney, Agent, or Firm*—Lerner, David, Littenberg & Samuel

[57] ABSTRACT

A machine for compressing and wrapping a coil of wire material is provided which includes a press for compressing the wire coil and wrapping means for wrapping the compressing wire coil with binding wire. The press includes first and second press means movable relative to each other with the first press means including pressing surfaces and the second press means including a pressing plate wherein the pressing plate cooperates with the pressing surfaces for compressing the wire coil. The first press means further includes wrapping means for wrapping the compressed wire coil with a binding wire and includes a substantially horizontal mandrel for receiving the wire coil and four press arms concentrically arranged about the mandrel and being relatively movable therewith to enclose the wire coil. Each of the press arms includes the pressing surfaces and first guide bars for guiding the binding wire. The mandrel includes second guide bars for guiding the binding wire, and the second guide bars are movably mounted relative to the mandrel so that the first and second guide bars cooperate to form a closed guide path for guiding the binding wire about the wire coil to be wrapped. Each of the press arms further includes a binding unit for joining the ends of the binding wire about the wire coil.

9 Claims, 6 Drawing Figures

PRESS BINDING MACHINE

FIELD OF THE INVENTION

The present invention relates to a machine for compressing and wrapping coils of wire material. The wire coils are first compressed and then the wrapping is carried out by using a binding wire or strip.

BACKGROUND OF THE INVENTION

Conventional apparatus for compressing and wrapping wire coils typically includes a mandrel about which the wire coil is positioned with the mandrel being either vertically or horizontally disposed. In addition, such apparatus typically includes a press for compressing the wire coil about the mandrel. After the pressing operation is completed, one or more movable carriages, having binding units mounted thereon, are advanced toward the wire coil for binding the wire coil with a wire band or strip. In conventional apparatus, wire guide tracks are also provided in the mandrel which are arranged to cooperate with wire guide tracks in the binding units when they are advanced toward the wire coil. In this manner, the wire guide tracks of the mandrel cooperate with the wire guide tracks of the binding units to thereby extend binding wire completely about the wire coil so that the wrapping and binding can take place.

The disadvantages with such conventional apparatus are that it requires separate carriages and binding units which require a great deal of space. In addition, the apparatus is difficult to manipulate and is highly unaccessible because several carriages and binding this unit must be placed about the wire coil. Moreover, in such conventional apparatus, the wrapping and binding of the wire coil may be carried out about a portion of the wire coil which is not fully compressed.

Broadly, it is an object of the present invention to provide a press binding machine which overcomes one or more of the aforesaid problems. Specifically, it is within the contemplation of the present invention to provide a press-binding machine which is constructed to have the binding units disposed directly on the press arms of the machine to thereby simplify the construction and operation of the machine.

It is a further object of the present invention to provide a press-binding machine in which the wire guide tracks are provided on the concentrically-arranged press arms, as well as on the mandrel, which cooperate to form a closed guide path for guiding the binding wire about the wire coil to be wrapped and thereby simplifies the construction and operation of the press-binding machine.

SUMMARY OF THE INVENTION

Briefly, in accordance with the principles of this invention, an improved press-binding machine is provided for compressing and wrapping a coil of wire material which includes a press for compressing the wire coil and wrapping means for warpping the compressed wire coil with a binding wire or strip. The press includes first and second press means which are relatively movable to each other and wherein the first press means includes pressing surfaces, and the second press means includes a pressing plate for cooperating with the pressing surfaces to compress the wire coil. The first press means also includes wrapping means for wrapping the compressed wire coil with a binding wire and includes a mandrel which is substantially horizontally disposed for receiving the wire coil and four press arms concentrically arranged about the mandrel and being relatively movable therewith to enclose and compress the wire coil. Each of the press arms includes the pressing surfaces and first guide bars for guiding the binding wire. The mandrel also includes second guide bars for guiding the binding wire, with the second guide bars being movably mounted relative to the mandrel so that the first and second guide bars cooperate to form a closed guide path for guiding the binding wire about the wire coil to be wrapped. Each of the press arms further includes binding units for joining the ends of the binding wire about the wire coil.

Accordingly, the present invention provides a number of advantages over conventional apparatus. More particularly, it is no longer necessary to move separate binding units into cooperation with the wire coil after it has been compressed. In the present invention, the binding units are disposed directly on the press arms which thereby simplifies the construction and operation of the machine. Moreover, in the present invention, wire guide tracks have been provided directly on the press arms which are concentrically disposed about the mandrel and which thereby cooperate with the wire guide tracks in the mandrel to form a closed guide path for guiding the binding wire about the wire coil to be wrapped. Accordingly, it is no longer necessary to provide wire guide tracks in the binding units which must then be coupled to the wire guide tracks in the mandrel.

BRIEF DESCRIPTION OF THE DRAWINGS

Further objects, features, and advantages of the present invention will become apparent upon the consideration of the following detailed description of a presently-preferred embodiment when taken in conjunction with the accompanying drawing, wherein.

DESCRIPTION OF PREFERRED EMBODIMENT

Figure 1:
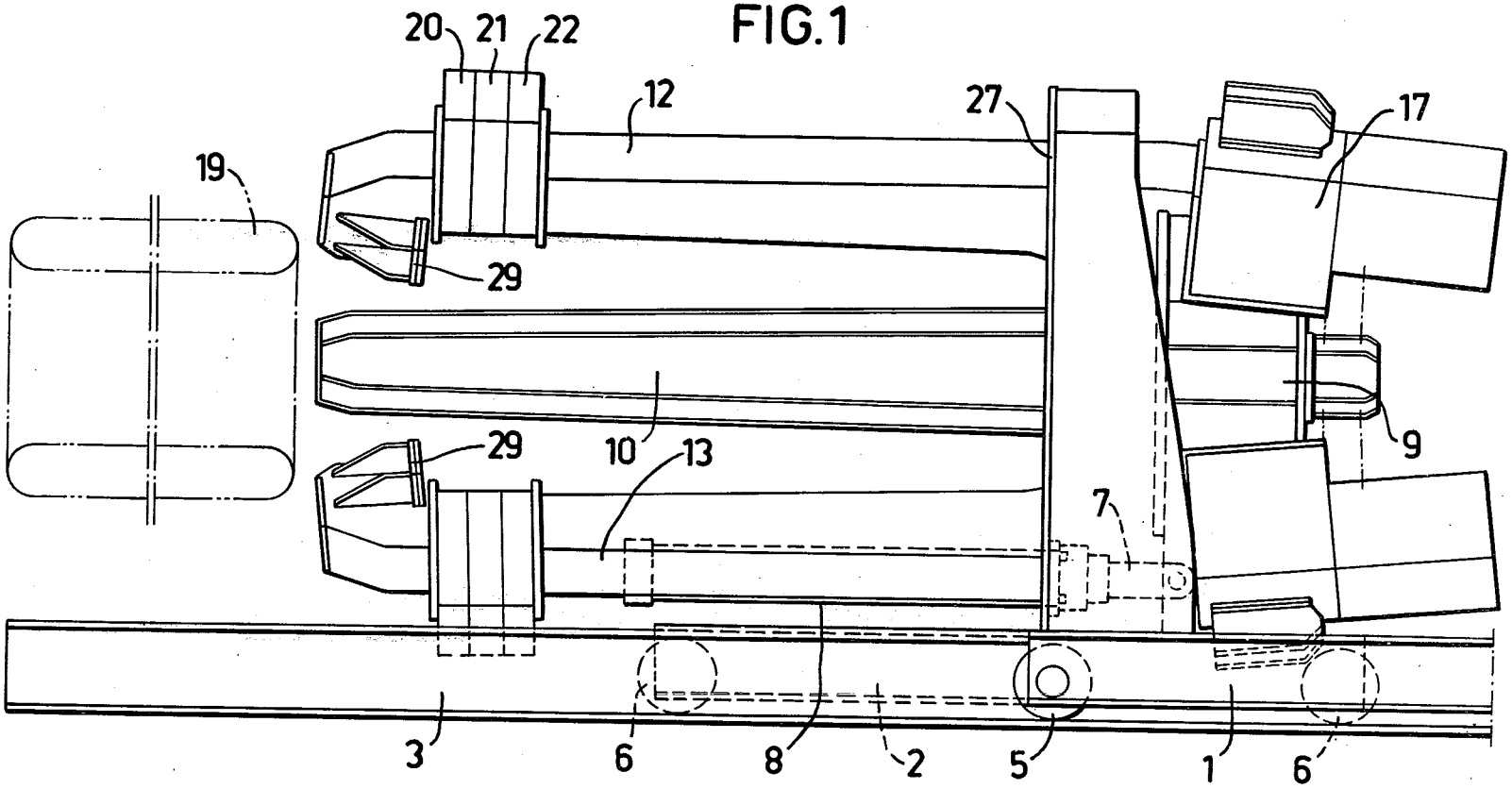
FIG. 1 is a side elevation of the press-binding machine of the present invention, with the mandrel ready to receive a wire coil and the press arms disposed in their open position.
Figure 2:
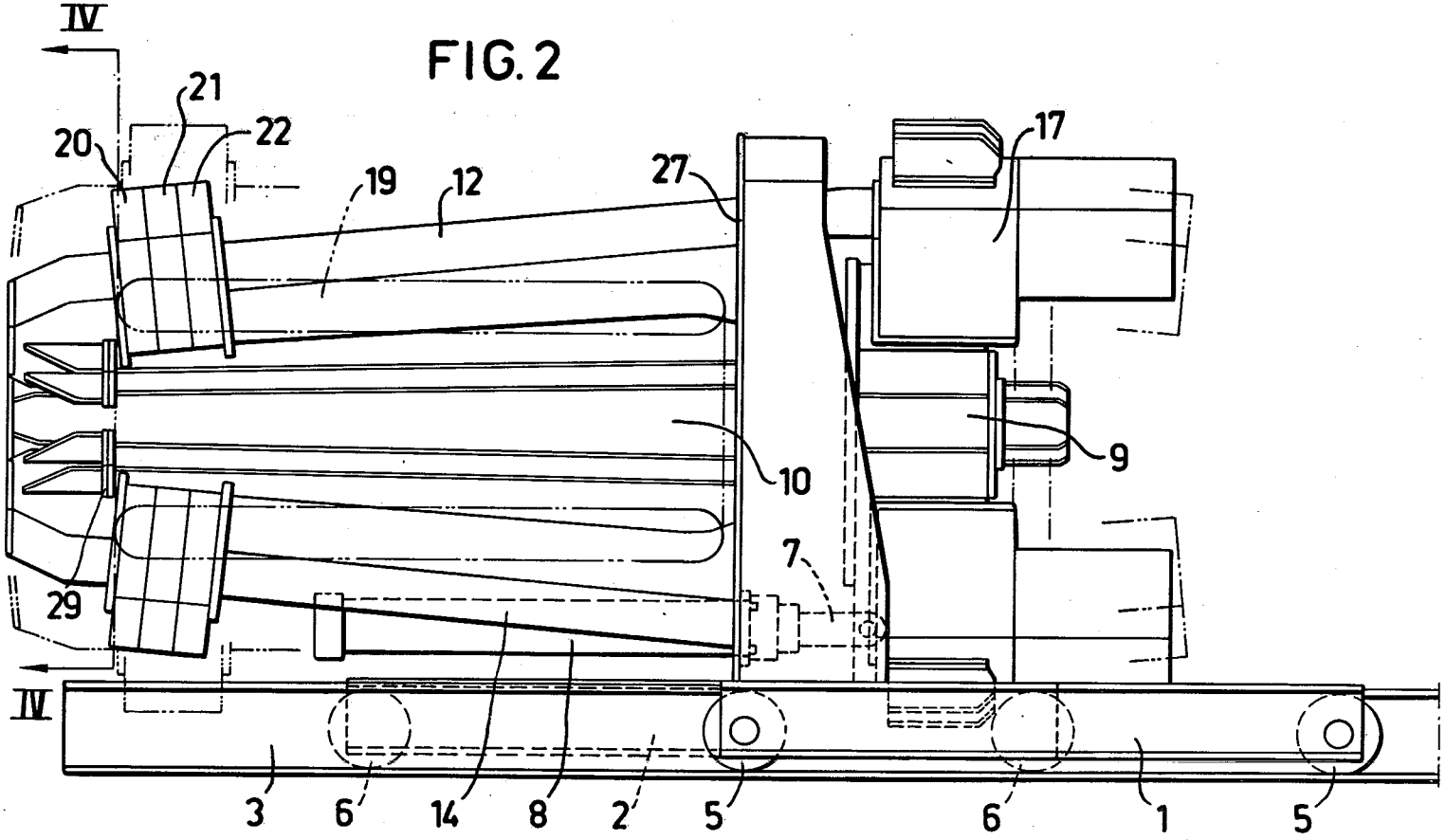
FIG. 2 is a side elevation illustrating the wire coil disposed on the mandrel and the concentrically-arranged press arms in their closed position.
Figure 3:
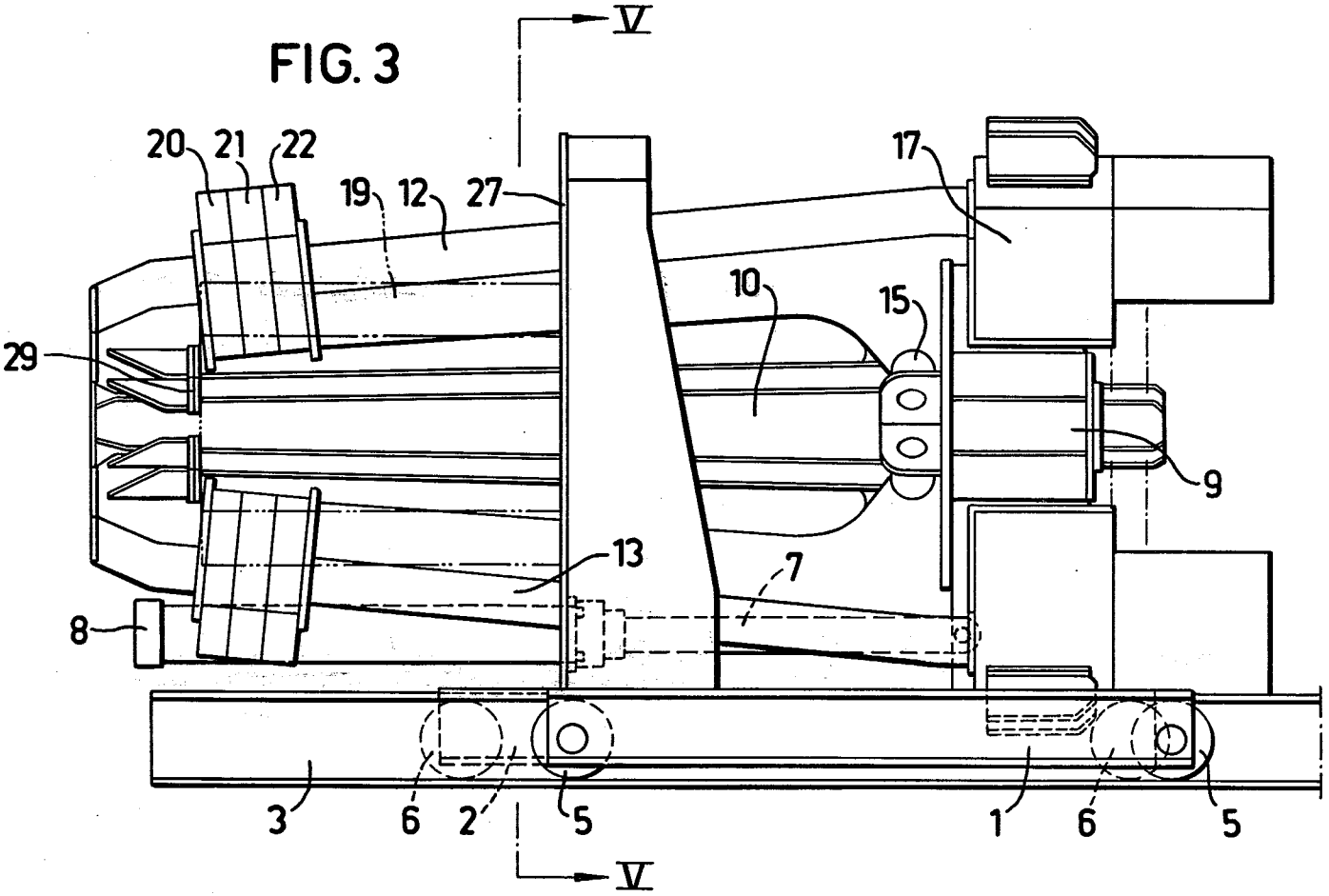
FIG. 3 is a side elevation of the present invention illustrating the pressing plate moved into position to compress the wire coil.
Figure 5:
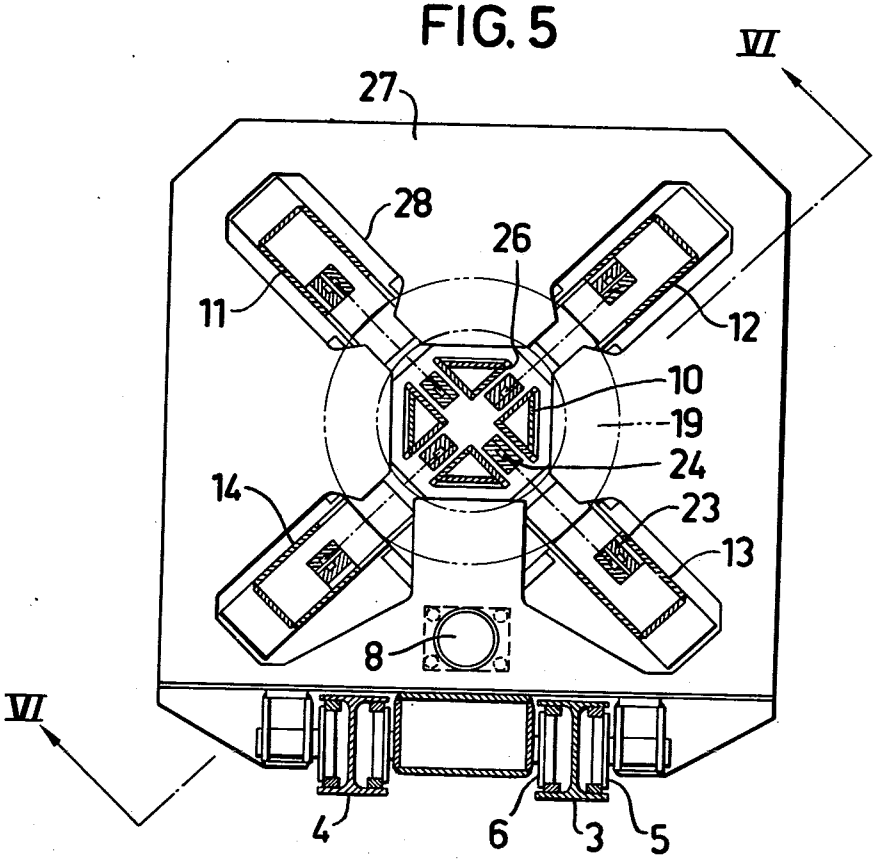
FIG. 5 is a sectional view, taken on the line 5—5 of FIG. 3, illustrating the details of the arrangement of the press arms and mandrel relative to the pressing plate.
Figure 4:
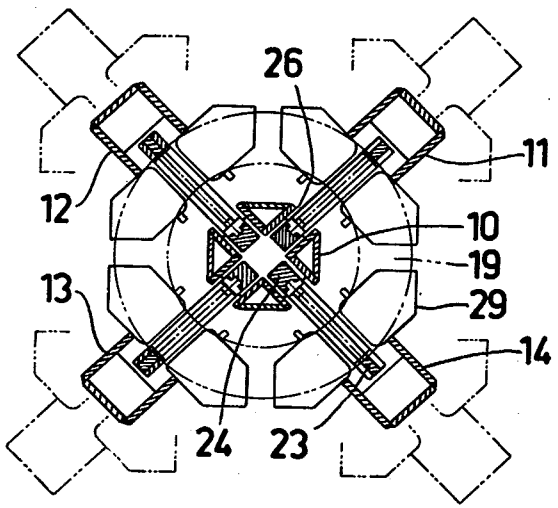
FIG. 4 is a sectional view, taken on the line 4—4 of FIG. 2, to illustrate the details of the guide bars of the press arms and mandrel.
Figure 6:
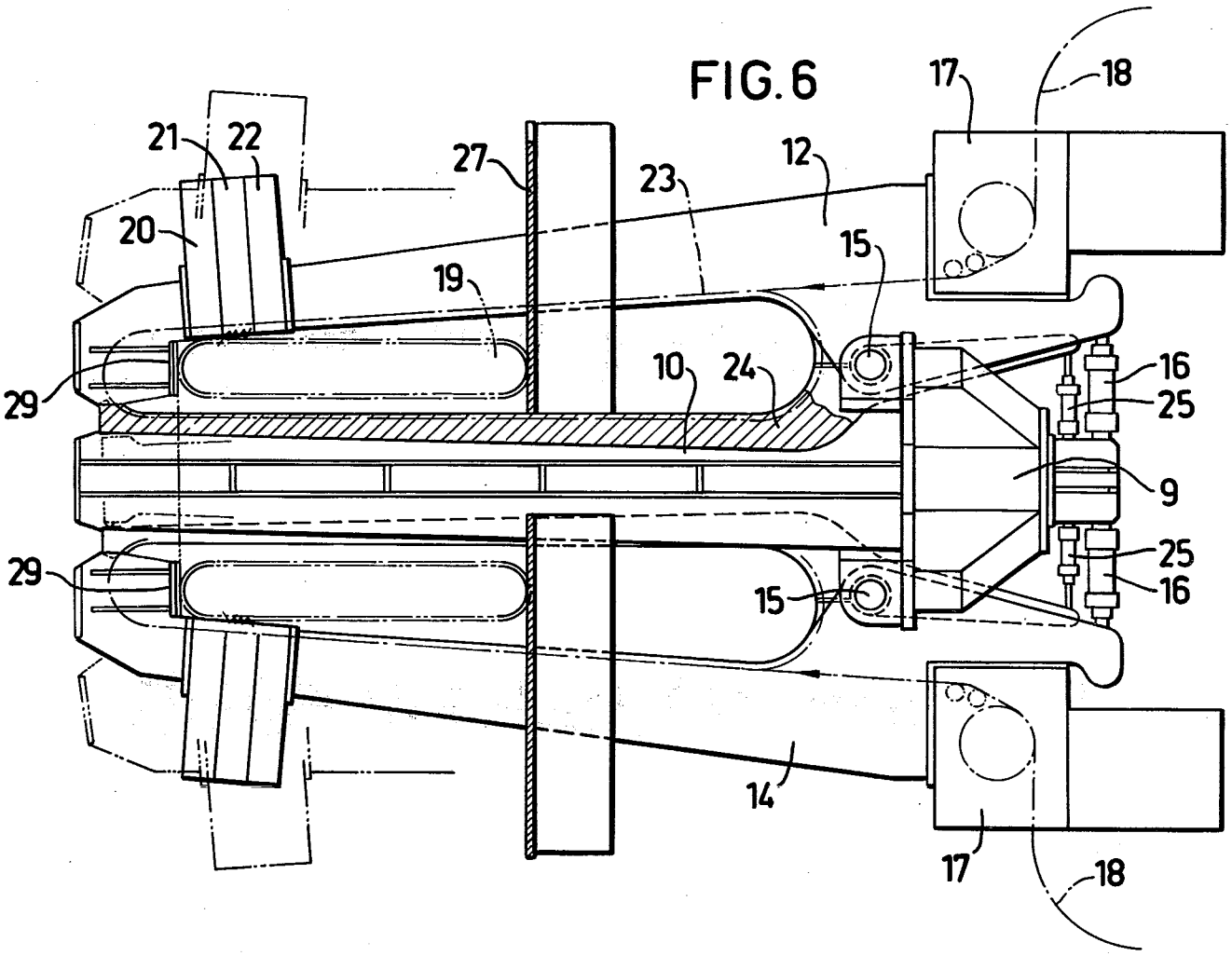
FIG. 6 is a sectional view, taken on line 6—6 of FIG. 5, illustrating the manner in which binding wire is supplied to the guide bars which enclose the wire coil to be wrapped.

The press-binding machine of the present invention includes two carriages 1, 2 which are movable along respective I-shaped guides 3, 4. Guides 3, 4 are formed with bars for the wheels 5, 6 of the two carriages 1, 2, each wheel running on one side of the web of the I-shaped guides. In the embodiment shown, the carriages 1, 2 are connected by means of a piston rod 7 which forms part of a press cylinder 8. Rod 7 is connected to carriage 1, and the press cylinder 8 is connected to the other carriage 2. Carriages 1, 2 are thereby movable relative to each other by means of the press cylinder 8, which is operated by a pressure medium.

Carriage 1 is provided with a stand 9, on which a substantially horizontal mandrel 10 is mounted, and four press arms 11–14 are concentrically arranged about mandrel 10. Press arms 11–14 are arranged in pairs directly opposite each other (11, 13 and, respectively, 12, 14) and offset 45° in relation to the horizontal plane. In this manner, space is provided between the upper press arms 12, 14, for example, for a hook or arm carrying the coil 19 to be wrapped. Such an arrangement also insures good accessibility during loading. A corresponding free space is also provided between lower arms 11, 13 when desired to position the coil on a pair of longitudinal beams or the like. In embodiments having two, three, or more than four press arms, the aforesaid free spaces should also be provided. The press arms 11–14 are pivotally attached to the stand 9 about pins 15 so as to be able to pivot to and from the mandrel 10. The arms are operated by piston and cylinders 16 secured in the stand 9.

Each press arm 11–14 is provided with a feed unit 17 and a binding unit 20 to 22, for example, of the kind described in U.S. Pat. No. 3,889,584. The feed unit 17 feeds binding wire 18 from a wire supply (not shown) about the wire coil 19 to be wrapped. A feed unit 17 is located at the rear portion of each press arm. The binding unit 20 to 22 is disposed near the free end of each press arm and includes a locking unit 20, a twisting unit 21, and a cutting unit 22. The binding unit, however, may also be disposed further inwardly on the arm. The essential factor for its positioning is that the twisting unit must be located inside of the end plane of the wire coil after the coil has vbeen compressed.

For guiding the binding wire 18 from the feed unit 17 about the wire coil 19, guide bars 23 are provided in each press arm 11–14, and guide bars 24 are provided in the mandrel 10. Guide bars 24 extend along the mandrel and are pivotal about the pins 15 by means of cylinders 25 attached to the stand 9 so that they can be folded into and out of grooves 26 in the mandrel 10 and are thereby movable into and out of the binding position.

In the binding position, the two sets of guide bars 23, 24 form a closed track for the binding wire 18 about the wire coil 19. The guide bars 23, 24 have closed grooves which are opened by the binding wire 18 when it is stretched by the feed unit 17 because the guide bars are held together by means of an elastic pressure. The elastic pressure is overcome when the stretching takes place whereby the binding wire is released from the guide bars for abutment about the wire coil 19.

Before binding takes place, the wire coil is to be compressed. This is brought about by displacing the two carriages 1, 2 relative to each other by means of the press cylinder 8. The carriage 2 is provided for this purpose with a pressing plate 27 which is provided with recesses 28 through which the mandrel 10 and press arms 11–14 extend. pressing plate 27 cooperates with pressing surfaces 29 on the free end of each press arm so that the wire coil 19 is compressed between the pressing surface 29 and the pressing plate 27 when the carriages 1, 2 are displaced relative to each other. The pressing surfaces 29 are so disposed that they leave only a narrow space for the binding wire 18. This implies that the binding takes place when the wire coil 19 is compressed to its maximum.

Due to the pivotal arrangement of the press arms 11–14 with the guide bars 23, and the pivotal arrangement of the guide bars 24 in the mandrel 10, wire coils 19 of varying diameters can be wrapped. Therefore, for wire coils with a greater diameter, the guide bars 24 are folded out a greater distance in order to cooperate with the guide bars 23 in the press arms 11–14.

The mode of operation of the machine is as follows. The two carriages 1, 2 are moved from the starting position (FIG. 1) towards the wire coil 19 to be wrapped. The mandrel 10 thereby projects into the wire coil. When the pressing plate 29 have passed the remote end of the wire coil 19, the press arms 11–14 are pivoted inwardly to the outer diameter of the wire coil, and at the same time, the guide bars 24 are pivoted outwardly toward the press arms so that a closed track for the binding wire 18 is formed about the wire coil. The compressing of the wire coil is caused by press cylinder 8 displacing the two carriages 1, 2 in relation to each other, whereby the wire coil is pressed between the pressing plate 27 and the pressing surfaces 29 on the press arms 11–14. Binding wire is fed by the guide unit 17 through the guide bars 23, 24, and the free end of the binding wire is locked in the locking unit 20. The binding wire is stretched thereby, and the feeding unit 17 is reversed, whereby the binding wire is pulled out of the guide bars 23, 24 to tightly engage and surround the compressed wire coil. The binding wire, however, is retained in the binding unit 20 to 22 until the binding wire has been twisted into a knot in the twisting unit 21 and has been cut off in the cutting unit 22. The binding time can be shortened by carrying out the feeding and stretching of the binding wire during the compressing operation.

The press cylinder 8 thereafter returns, the press arms 11–14 pivot outwardly, and the guide bars 24 are folded into the mandrel 10 to expose the compressed and wrapped wire coil 19. The machine, finally, is retracted to the starting position.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A machine for compressing and wrapping a coil of material, comprising a press for compressing the coil including first press means and second press means movable relative to each other, said first press means including wrapping means for wrapping the compressed coil with a binding member, said first press means including a mandrel substantially horizontally disposed for receiving said coil and at least two press arms concentrically arranged about said mandrel and means for moving said press arms with respect to said mandrel for enclosing said coil; each of said press arms includes pressing surfaces, first guide bars for guiding the binding member, and means for joining the ends of said binding member about said coil; said mandrel including second guide bars for guiding the binding member, means for moving said second guide bars relative to said mandrel to move between a first position and a second position so that when said second guide bars are in said second position, said first and second guide bars cooperated to form a closed guide path for guiding and binding member about said coil to be wrapped, and said second press means includes a pressing plate for cooperating with said pressing surfaces for compressing said coil.

2. A machine according to claim 1 wherein said first and second press means are each mounted to be movable.

3. A machine according to claim 2 wherein said first and second press means each include movable carriages which move relative to each other.

4. A machine according to claim 1 wherein said press arms and said second guide bars are pivotally mounted on said first press means.

5. A machine according to claim 1 wherein said first and second press means include a press cylinder for moving said press means relative to each other and which produces the force required for compressing the coil.

6. A machine according to claim 1 further including horizontally-disposed guides wherein said first and second press means are movable along said horizontally-disposed guides.

7. A machine according to claim 1 wherein said joining means is disposed at one end of each of said press arms.

8. A machine according to claim 7 wherein said joining means includes a locking unit, a twisting unit, and a cutting unit.

9. A machine according to claim 1 wherein said pressing surfaces are disposed at one end of each of said press arms.

* * * * *

UNITED STATES PATENT OFFICE

CERTIFICATE OF CORRECTION

Patent No. 4,020,755 Dated May 3, 1977

Inventor(s) Sven Arne Böhlmark

It is certified that error appears in the above-identified patent and that said Letters Patent are hereby corrected as shown below:

Column 4, line 24, "the guide" should read -- feeding --.

Column 5, line 2 "and" should read -- said --.

Signed and Sealed this nineteenth Day of July 1977

[SEAL]

Attest:

RUTH C. MASON
Attesting Officer

C. MARSHALL DANN
Commissioner of Patents and Trademarks